US012604989B2

(12) United States Patent
Cagle

(10) Patent No.: US 12,604,989 B2
(45) Date of Patent: Apr. 21, 2026

(54) COLLAPSIBLE STOOL

(71) Applicant: AdvenTech, LLC, Newport, NC (US)

(72) Inventor: Matthew F. Cagle, Morehead City, NC (US)

(73) Assignee: Adventech, LLC, Newport, NC (US)

( * ) Notice: Subject to any disclaimer, the term of this patent is extended or adjusted under 35 U.S.C. 154(b) by 119 days.

(21) Appl. No.: 18/191,543

(22) Filed: Mar. 28, 2023

(65) Prior Publication Data

US 2023/0355000 A1 Nov. 9, 2023

Related U.S. Application Data

(60) Provisional application No. 63/362,677, filed on May 3, 2022.

(51) Int. Cl.
*A47C 9/10* (2006.01)
*A47B 3/08* (2006.01)

(52) U.S. Cl.
CPC ..... *A47C 9/10* (2013.01); *A47B 2003/0827* (2013.01)

(58) Field of Classification Search
CPC .... A47C 9/10; A47B 3/14; A47B 3/10; A47B 2003/0827; A47B 2003/045
See application file for complete search history.

(56) References Cited

U.S. PATENT DOCUMENTS 816,853 A * 4/1906 Eisele ..... A47C 4/24 297/53
2,299,579 A * 10/1942 Kennedy ..... A47D 5/006 4/586
2,982,455 A * 5/1961 Rosen ..... A47C 4/48 294/142
3,103,900 A * 9/1963 Lippman ..... A47B 37/00 108/119
4,565,382 A * 1/1986 Sherman ..... A47B 3/10 D34/21
5,483,901 A * 1/1996 Tisbo ..... A47B 3/02 248/164
7,640,869 B2 * 1/2010 Leng ..... A47B 9/16 108/120
8,931,832 B2 * 1/2015 Lau ..... A47C 7/407 297/53
2008/0179358 A1 * 7/2008 Redzisz ..... A47C 9/10 224/155
2012/0080461 A1 * 4/2012 Drollinger ..... A47C 9/10 297/183.1
2016/0058192 A1 * 3/2016 Drew ..... A47C 3/18 297/344.21
2017/0188697 A1 * 7/2017 Lin ..... A47C 11/00
(Continued)

FOREIGN PATENT DOCUMENTS

BR 202017008857 U2 * 11/2018
BR 202019003374 U2 * 9/2020
(Continued)

*Primary Examiner* — Timothy J Brindley
(74) *Attorney, Agent, or Firm* — BakerHostetler

(57) ABSTRACT

A collapsible stool can be used in an open position and collapsed to a closed position. The collapsible stool includes first and second leg members. The first and second leg members can be rotatably coupled. A stop mechanism can be utilized to maintain the first and second leg members in open and closed positions.

14 Claims, 6 Drawing Sheets

(56) References Cited

U.S. PATENT DOCUMENTS

| | | | | |
|---|---|---|---|---|
| 2017/0354257 | A1* | 12/2017 | Frady | A47C 9/10 |
| 2021/0007496 | A1* | 1/2021 | Morgan | A47C 7/66 |

FOREIGN PATENT DOCUMENTS

| | | | | | |
|---|---|---|---|---|---|
| CN | 106136571 | A | * | 11/2016 | A47B 3/0803 |
| KR | 200301441 | Y1 | * | 1/2003 | |
| KR | 20100001214 | U | * | 2/2010 | |
| KR | 101769055 | B1 | * | 8/2017 | |

* cited by examiner

COLLAPSIBLE STOOL

CROSS-REFERENCE TO RELATED APPLICATIONS

This patent application claims priority to and the benefit of provisional patent application 63/362,677 filed Apr. 8, 2022, which is incorporated herein by its entirety.

BACKGROUND

A variety of folding or collapsible seat designs are available on the market. However, existing designs include a number of drawbacks pertaining to several issues involving comfort, convenience, usability, sturdiness, fit and finish, manufacturing, et cetera.

SUMMARY

In an embodiment, a collapsible stool comprises a first leg member comprising a first pair of legs extending from a first top portion; a second leg member comprising a second pair of legs extending from a second top portion, wherein an outer dimension of the second leg member is less than an inner dimension of the first leg member; a pair of pinned connections rotatably coupling the first leg member and the second leg member; a stop mechanism arranged around the first and second top portion, wherein at least the second top portion is configured to translate through the stop mechanism to open and close the collapsible stool, and wherein the stop mechanism is configured to rotate about at least the first top portion; and a seat operatively coupled with the stop mechanism. While this summary is intended to describe certain aspects of the disclosure, it should not be read in any way as limiting the scope or spirit of the specification, drawings, or claims, which describe additional and alternative aspects.

DETAILED DESCRIPTION

Figure 1:
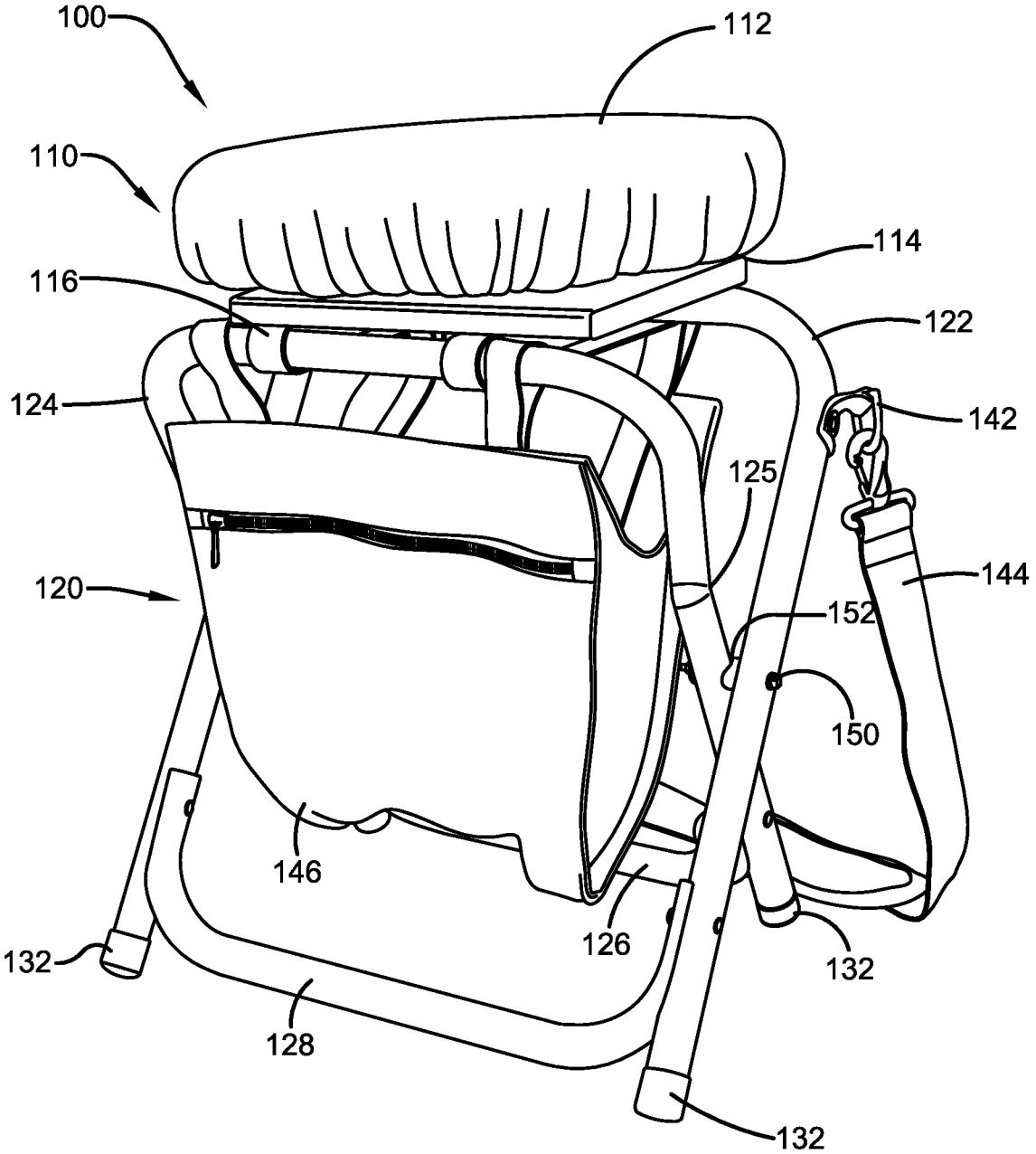
FIG. 1 illustrates an example collapsible stool disclosed herein.

As described herein, the "top" of collapsible stool 100, or "up" direction, is toward the end defined by seat 112, and the "bottom" of collapsible stool 100, or "down" direction, is toward the end defined by caps 132 or where collapsible stool 100 interfaces with the ground or a floor when in use. These same directions can be used with respect to each embodiment disclosed herein, whether pertinent to FIGS. 1, 2A, and 2B or others.

Collapsible stool 100 comprises seat section 110 and support section 120. Seat section 110 includes seat 112, coupling assembly 114, and stop mechanism(s) 116. Support section 120 includes first leg member 122 and second leg member 124, which are coupled using pinned connections 150 to allow the first leg member 122 and the second leg member 124 to rotate in relation to one another to "open" or "close" support section 120. Collapsible stool 100 can have two pinned connections 150 coupling a respective leg of the pairs of legs provided by first leg member 122 and second leg member 124. First leg member 122 and second leg member 124 can include a top portion and a bend, radius, or corner where a pair of legs project from each to provide four legs for collapsible stool 100.

Seat 112 can be formed of any material or materials appropriate for utility or comfort. In embodiments, seat 112 can comprise a padded or cushioned material to facilitate comfort, weight distribution, and reduced fatigue. Seat 112 can, in embodiments, comprise one or more of a water-resistant material, a non-slip material, and/or a stain-resistant material, which can be wrapped around or applied to a padded or cushioned material. Seat 112 can have a solid base underlying some or all of other portions of seat 112, preventing seat 112 from folding over at the edges or collapsing in the middle based on how a user's weight is distributed.

Seat 112 (or a portion thereof, such as a solid base) is attached to coupling assembly 114. Seat 112 may be fixedly or removably attached to coupling assembly 114 using hardware (e.g., screws and bolts), adhesives, welding, magnets, hook-and-loop, or other suitable means. Seat 112 may be rotatable with respect to coupling assembly 114 such that a user can spin seat 112 with respect to other components of collapsible stool 100 to allow a user to easily reorient without having to move their body with respect to seat 112 or move collapsible stool 100 with respect to the ground beneath. In embodiments, seat 112 can be designed to rotate silently.

In an embodiment, seat 112 can have joint attaching seat 112 to coupling assembly 114 allowing seat 112 to be angled or canted with respect to coupling assembly 114. In embodiments the joint can be arranged at the top of a shaft between seat 112 and coupling assembly 114 such that seat 112 can still rotate as described above while tilting for user comfort, stability, or ease of use.

Coupling assembly 114 is disposed between seat 112 and stop mechanism(s) 116. In embodiments, coupling assembly 114 can serve as a solid base to seat 112, or, in alternative embodiments, can couple to solid base 112. Coupling assembly 114 can attach to stop mechanism(s) 116 using hardware (e.g., screws and bolts), adhesives, welding, magnets, or other suitable means. In embodiments, coupling assembly 114 can be a span fixing the distance between two or more elements of stop mechanism 116 and the positioning of stop element 116 with respect to seat 112.

Stop mechanism 116 can comprise one or more components configured to stop the movement of first leg member 122 and second leg member 144 when opening the collapsible stool 100. Because the illustrated embodiments of stop mechanism 116 show two components, they will be referred hereafter as "stop mechanisms 116," but such language should not be interpreted to limit the scope of the disclosure or claims to two stop mechanism 116 components. Alternative embodiments could utilize a single-component stop mechanism 116 (e.g., one loop or hook), or three-(or more) component stop mechanisms 116. Similarly broad interpretations of singular and plural uses of "stop mechanism" are to be applied throughout all portions and Figures of this disclosure.

Stop mechanisms 116 are positioned to wrap around both first leg member 122 and second leg member 124. When collapsible stool 100 is "closed" (see, e.g., FIGS. 2A and 2B) a top portion of one or both of first leg member 122 and second leg member 124 can translate within the lengths of stop mechanisms 116 as the top portions of first leg member 122 and second leg member 124 move toward each other (see, e.g., FIG. 2A) and close fully with, in the illustrated embodiment, second leg member 124 within and substantially surrounded by first leg member 122 (see, e.g., FIG. 2B). In the "closed" arrangement, stop mechanisms 116 can rotate downward such that its exterior dimensions substantially align with the contours of first leg member 122 and second leg member 124, stowing substantially within the footprint of first leg member 122 to reduce the closed profile of collapsible stool 100 for secure and easy carriage.

To facilitate consistent positioning of stop mechanisms 116 with respect to first leg member 122 and second leg member 124 in open and closed arrangements of collapsible stool 100, stop mechanisms 116 can in embodiments include a component for rotatably fixing stop mechanisms 116 with respect to one or both of first leg member 122 or second leg member 124. For example, stop mechanisms 116 can include a loop or ring around second leg member 124 to prevent second leg member 124 from translating toward first leg member 122 within stop mechanisms 116; rather, first leg member 122 would translate through stop mechanisms 116 toward second leg member 124 when closing, and away from second leg member 124 when opening, with second leg member 124's position with respect to stop mechanisms 116 remaining substantially unchanged (other than rotation). Such a loop or ring can be defined in part by the outer diameter of the end of stop mechanisms 116 in contact with or in proximity to the top of first leg member 122 and include an extension or closure around the top of first leg member 122. The extension or closure can create a circle or oval, comprise a flat wall, or take any other shape. In an embodiment, stop mechanisms 116 can be necked or include a pinch point to block movement of first leg member 122 through stop mechanisms 116 while still permitting rotation of stop mechanisms 116 with respect to first leg member 122.

In embodiments, an internal extension or loop can provide space for limited translation of first leg member 122 within stop mechanisms 116 but retain the position of first leg member 122 substantially toward the end of stop mechanisms 116 opposite the position of second leg member 124 to facilitate easier opening and closing. In such embodiments, the arrangement can provide for limited translation substantially equal to a fraction of a diameter (or other cross-sectional measure) of first leg member 122, the diameter (or other cross-sectional measure) of first leg member 122, twice the diameter (or other cross-sectional measure) of first leg member 122, three times the diameter (or other cross-sectional measure) of first leg member 122, four times the diameter (or other cross-sectional measure) of first leg member 122, or more. In embodiments, the block substantially or partially preventing translation of first leg member 122 within stop mechanisms 116 can be in fewer than all of the stop mechanisms 116 (e.g., only included in one of two stop mechanisms 116, included in fewer than all stop mechanisms 116 in embodiments with three or more stop mechanisms 116, et cetera).

In embodiments, a snap or magnet can be used at ends of stop mechanisms 116 in contact with or proximity to second leg member 124 to resist unintended closure of collapsible stool 100. In an embodiment, second leg member 124 and an end of at least one stop mechanism 116 can be arranged to be magnetically attractive. In an embodiment, other portions of at least one stop mechanism 116 and/or first leg member 122 can be magnetized to prevent unintended opening of collapsible stool 100 when in a fully closed position. Alternatively a snap (e.g., narrowed but flexible portion of one or more stop mechanisms 116, flexible attachment to interior of one or more stop mechanisms 116) can be utilized to hold collapsible stool in an open or closed position.

As indicated above, where stop mechanism 116 comprises two or more components, the spacing of the components can be defined in part by, e.g., where the components of stop mechanism 116 attach to coupling assembly 114. For example, stop mechanism 116 can be attached at two or more points (e.g., using bolts, screws, or similar hardware), or along a line or throughout an area (e.g., by weld, adhesive, or hardware fixing stop mechanism 116 and coupling assembly 114 with respect to both translation and rotation in relation to one another).

Various arrangements can be employed to prevent side-to-side translation of seat 112 with respect to support assembly 120. In an embodiment, stop mechanisms 116 can be sized to fit within a channel or track (e.g., area of reduced diameter) of first leg member 122 and second leg member 124. In an embodiment, washers, gaskets, collars, or other components preventing translation of stop mechanisms 116 along first leg member 122 and/or second leg member 124 can be arranged on the inboard or outboard sides of one or all of stop mechanisms 116. In embodiments, the geometries of one or both of first leg member 122 and/or second leg member 124 and one or all of stop mechanisms 116 can be defined in a manner that prevents stop mechanisms 116 from having room to move. For example, the spacing of stop mechanisms 116 can arrange them near or against curved portions of one or both of first leg member 122 and/or second leg member 124 such that motion is substantially prevented due to the radii (or other dimensions) of the ends of stop mechanisms 116 and the curvature (or other shape or dimension) of first leg member 122 and/or second leg member 124.

The various embodiments can be mixed and matched, utilizing any of the foregoing arrangements in combination or on different of the stop mechanisms 116 in a single collapsible stool 100. Further, arrangements described with respect to first leg member 122 can in alternative embodiments be applied to second leg member 124, e.g., first leg member 122 can be configured to move toward second leg member 124 during closing and away from second leg member 124 during opening.

Stop mechanisms 116 can be formed of any suitable material or combinations of materials, including, but not limited to, aluminum, steel, and/or other metals; hard polymers, or other rigid materials. In embodiments, one or more stop mechanisms 116 can be formed of a flexible or partially flexible material, such as cabling, chains, rope, elastic, flexible polymers, et cetera.

First leg member 122 comprises a substantially tubular member with two tubular portions extending from the top portion that interacts with the stop mechanisms 116. The two tubular portions serve as two of four legs for the collapsible stool 100 when opened. The legs can include caps 132, which can close the tubular members to prevent unwanted materials from entering the tubes, quiet use of collapsible stool by providing a soft surface, and assist with the stability of collapsible stool 100 by providing a flexible and/or non-slip point of contact.

Second leg member 124 comprises a substantially tubular member with two tubular portions extending from the top portion that interacts with the stop mechanisms 116. The two tubular portions serve as two of four legs for the collapsible stool 100 when opened. The legs can also include caps 132 providing the functionality described above. Second leg member has outer dimensions less than or substantially equal to (factoring in a clearance or tolerance) the inner dimensions of first leg member 122, allowing second leg member to fit within or pass through first leg member 122 without interference.

The pair of legs of second leg member 124 include a deflection 125 above pinned connection 150. The deflection 125 allows second leg member 124 to arrange beneath first leg member 122 when first leg member 122, second leg member 124, and stop mechanisms 116 are rotated into a closed position. In an embodiment, the deflection 125 can be about 10 degrees from the primary axis (e.g., line through the center of leg below deflection 125) of the legs of second leg member 124, forming a 170-degree angle at the interior (e.g., angle facing first leg member 122 when collapsible stool 100 is open) of the two portions of each leg of second leg member 124. In alternative embodiments, the deflection 125 can be 5 degrees or less, 15 degrees, 20 degrees or more, or any other suitable deflection 125 to permit the described functionality based on the size and shape of first leg member 122 and second leg member 124 and/or other components of collapsible stool 100.

First leg member 122 and second leg member 124 can have the same height when collapsible stool 100 is in an open position to provide a substantially level seat when collapsible stool 100 is arranged on a level surface. As such, the total length of second leg member 124 may be longer than the total length of first leg member 122 to account for deflection 125.

First leg member 122 and second leg member 124 meet at pinned connection 150. Pinned connection 150 can be a bolt, shaft, or other suitable member. In embodiments, pinned connection 150 can include a buffer 152 between first leg member 122 and second leg member 124 to stabilize first leg member 122 and second leg member 124 and fix the clearance between first leg member 122 and second leg member 124. The buffer may rotate freely, or may be contoured (e.g., having a shape at least partially matching the curve of one or both of first leg member 122 or second leg member 124) or fixed to one or both of first leg member 122 and second leg member 124. In alternative embodiments first leg member 122 and second leg member 124 can be connected by a non-pinned means still fixing first leg member 122 and second leg member 124 in relation to one another while permitting rotation as described herein.

First leg member 122 and second leg member 124 can be rigid tubular members. First leg member 122 and second leg member 124 may, but need not be, cylindrical, and in the alternative can have any cross section. First leg member 122 and second leg member 124 can be formed of a single piece or multiple pieces connected together using hardware, friction fits, adhesives, welding, and/or other suitable means. First leg member 122 and second leg member 124 can include strengthening elements (e.g., thickened portions, collars or other reinforcing elements) at points subject to deformation or failure (e.g., the areas comprising or around deflection 125 of second leg member 124, the areas of first leg member 122 and second leg member 124 around pinned connection 150, et cetera).

Support section 120 can also include first leg brace 128 and second leg brace 126. First leg brace 128 can be installed or coupled to a bottom portion of first leg member 122, and second leg brace 126 can be installed or coupled to a bottom portion of second leg member 124. First leg brace 128 and second leg brace 126 can provide increased stability strength to first leg member 122 and second leg member 124, and can fix the distance between the legs of first leg member 122 and second leg member 124, to avoid bending or wear and ensure that second leg member 124 clears the interior of first leg member 122 during collapsing of collapsible stool 100 (and maintain those dimensions over time and use).

Collapsible stool 100 can include a variety of accessories. For example, pouch 146 can be arranged to hang from first leg member 122 and second leg member 124. Straps or other elements connecting pouch 146 to first leg member 122 and second leg member 124 can be arranged to wrap or attach inside or outside stop mechanisms 116 to prevent pouch 146 from sliding down over either side of first leg member 122 and second leg member 124. Pouch 146 can include a closure and be made of a flexible material allowing pouch 146 to be flattened when empty and lay neatly against collapsible stool 100 when collapsible stool 100 is closed.

Collapsible stool 100 can also include accessories for carriage of collapsible stool 100. Sling attachments 142 can be provided on the exterior of first leg member 122, and sling 144 can be attached thereto to facilitate carriage of collapsible stool 100. In embodiments, two or more sling attachments 142 can be provided on each leg of first leg member 122, or two ends of a first and second sling 144 can be attached to a single sling attachment 142, to provide for two-sling, backpack-style carriage.

Figure 3:
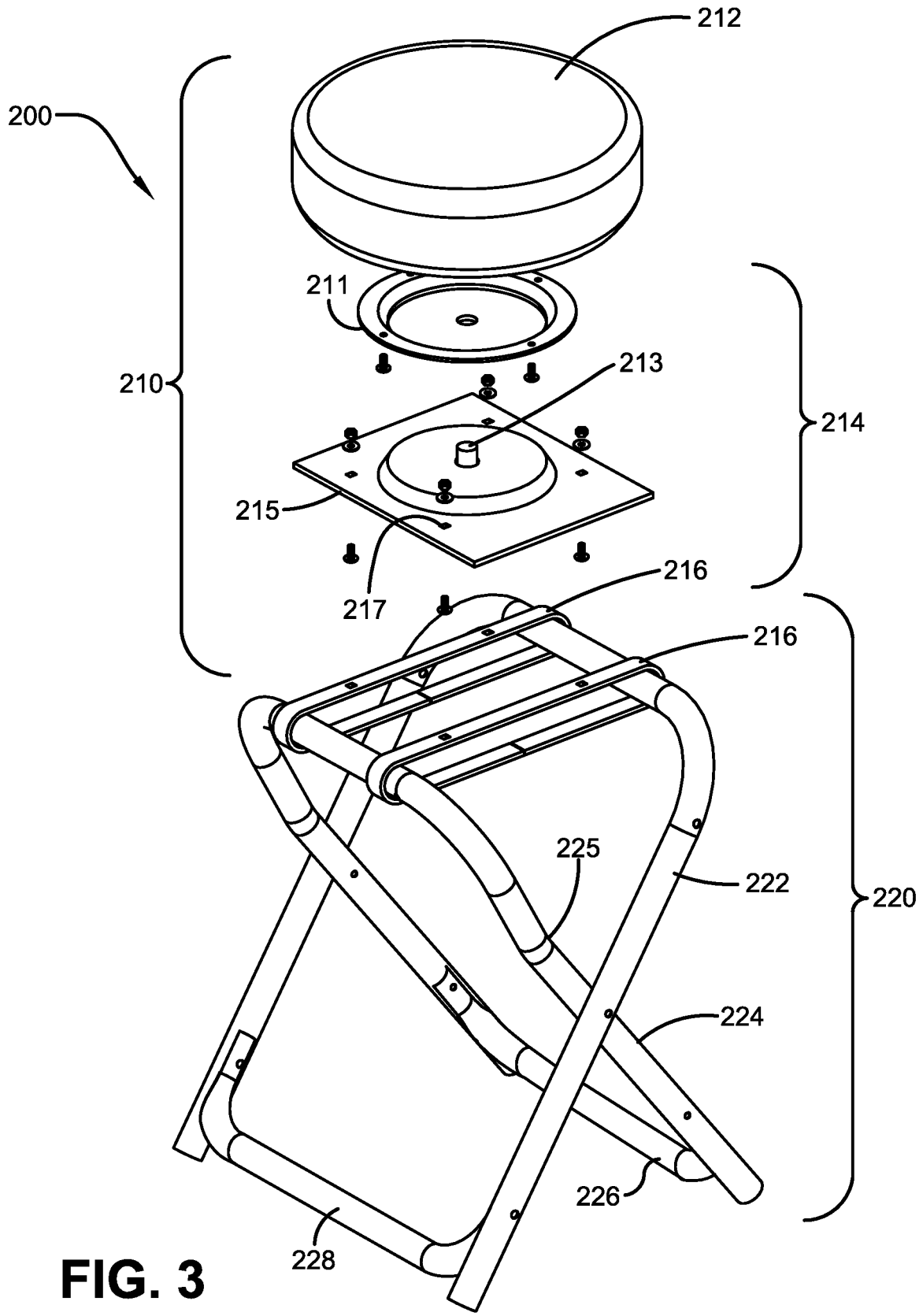
FIG. 3 illustrates a partially exploded view of a collapsible stool disclosed herein.

FIG. 3 illustrates a partially exploded view of collapsible stool 200 comprising seat section 210 and support section 220. Seat section 210 includes seat 212, coupling assembly 214, and stop mechanism 216. Support section 220 includes first leg member 222 and second leg member 224, which are coupled using pinned connection 250 to allow the first leg member 222 and the second leg member 224 to rotate in relation to one another to "open" or "close" support section 220. Second leg member 224 includes deflection 225. First leg member 222 and second leg member 224 can include first leg brace 228 and second leg brace 226, respectively.

Collapsible stool 200 functions in a manner substantially similar to that described above. Coupling assembly 214 is shown as containing seat base 211 operatively coupled to shaft 213 of coupling member 215. Coupling member 215 can include a plate and rotation assembly extending therefrom, where shaft 213 is attached by or partially contained within rotation assembly. By operatively coupling seat base 211 (and attached seat 212) to shaft 213, seat 212 can rotate freely with respect to coupling member 215.

Coupling member 215 can include various attachment points (e.g., 217) for attaching coupling member 214 to stop mechanisms 216. The attachment points of coupling member 215 can be configured to arrange stop mechanisms in an orientation with respect to first leg member 222, second leg member 224, and seat section 210. Various other attachment points and hardware can be used to connect the components of seat section 210 to one another. Such hardware and/or other means of attachment can be performed as described elsewhere herein or according to any appropriate means.

Figure 4:
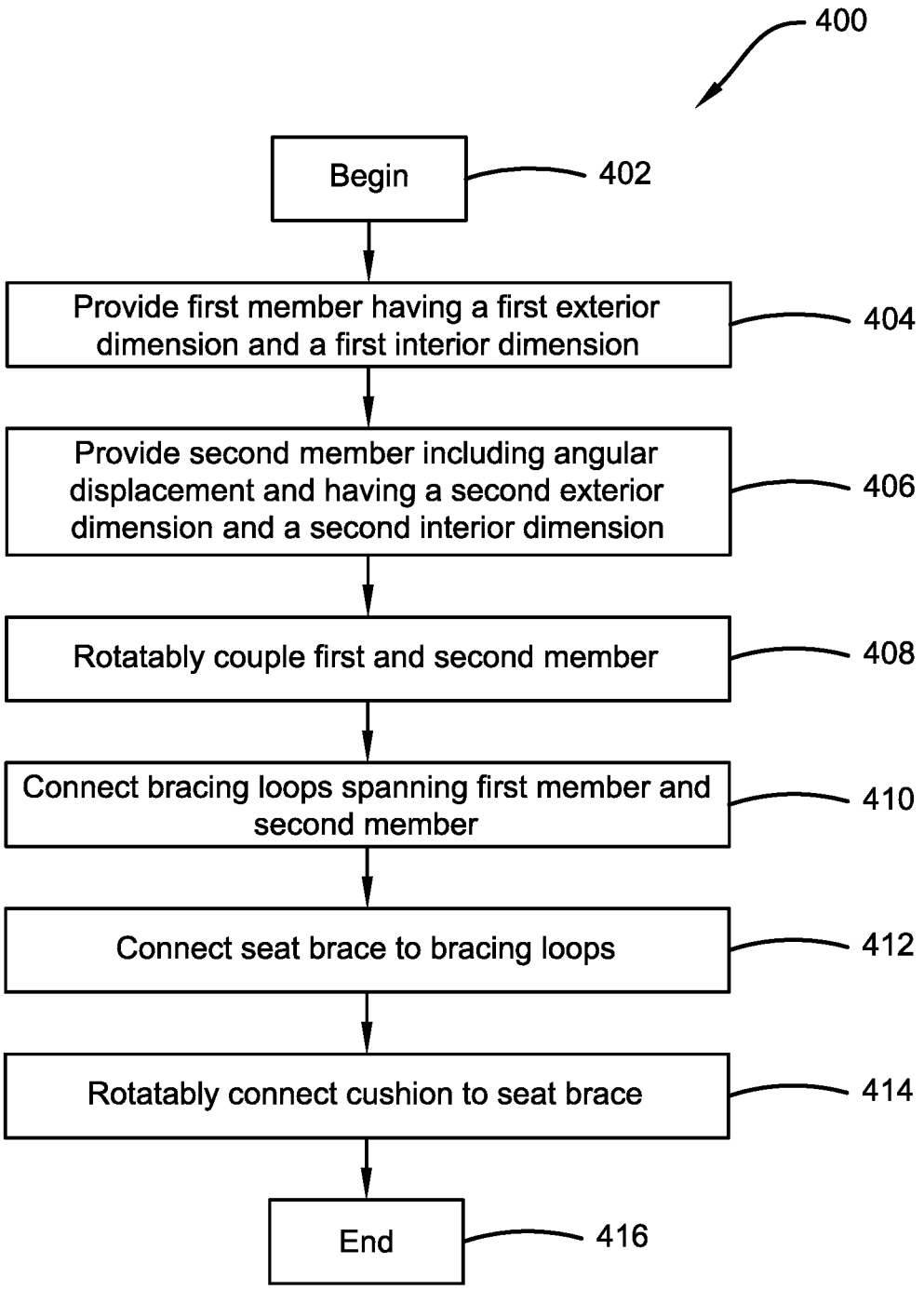
FIG. 4 illustrates an example method for making a collapsible stool disclosed herein.

FIG. 4 illustrates an example method 400 for making a collapsible stool disclosed herein. Method 400 begins at 402 and proceeds to 404 where a first leg member having a first exterior dimension and a first interior dimension is provided. The first leg member in step 404 can be a first leg member described herein.

Method 400 then proceeds to 406 where a second leg member including an angular deflection and having a second exterior dimension and second interior dimension is provided. The second leg member in step 406 can be a second leg member described herein. The second exterior dimension can be less than or substantially equal to the first interior dimension.

Method 400 then proceeds to 408 where the first leg member and the second leg member are rotatably coupled. Rotatably coupling the first and second leg member can occur at any appropriate length along the first and second leg members. In an embodiment, the coupling is arranged below the angular deflection of the second leg member. In an embodiment, the coupling may be arranged approximately one third of the height from the top of a collapsible stool being made, approximately one half of the height from the top of a collapsible stool being made, approximately one third from the bottom of a collapsible stool being made, or higher or lower.

Method 400 then proceeds to 410 where a stop mechanism is installed around the tops of the first and second leg members. The stop mechanism can be formed or assembled around the tops of first and second leg members. In an alternative embodiment, the stop mechanism can be installed in the same configuration for use by sliding over the tubular lengths of the first and second leg members before rotatably coupling the first and second leg members at 408. The stop mechanisms can be installed to specially formed parts of first and second leg members, or additional components can be installed to maintain the stop mechanisms in place as described herein.

Method 400 then proceeds to 412 where a coupling assembly is attached to the stop mechanism. Thereafter, at 414, a seat is rotatably coupled with the coupling assembly. With the collapsible seat assembled, method 400 can end at 416.

Figure 5A:
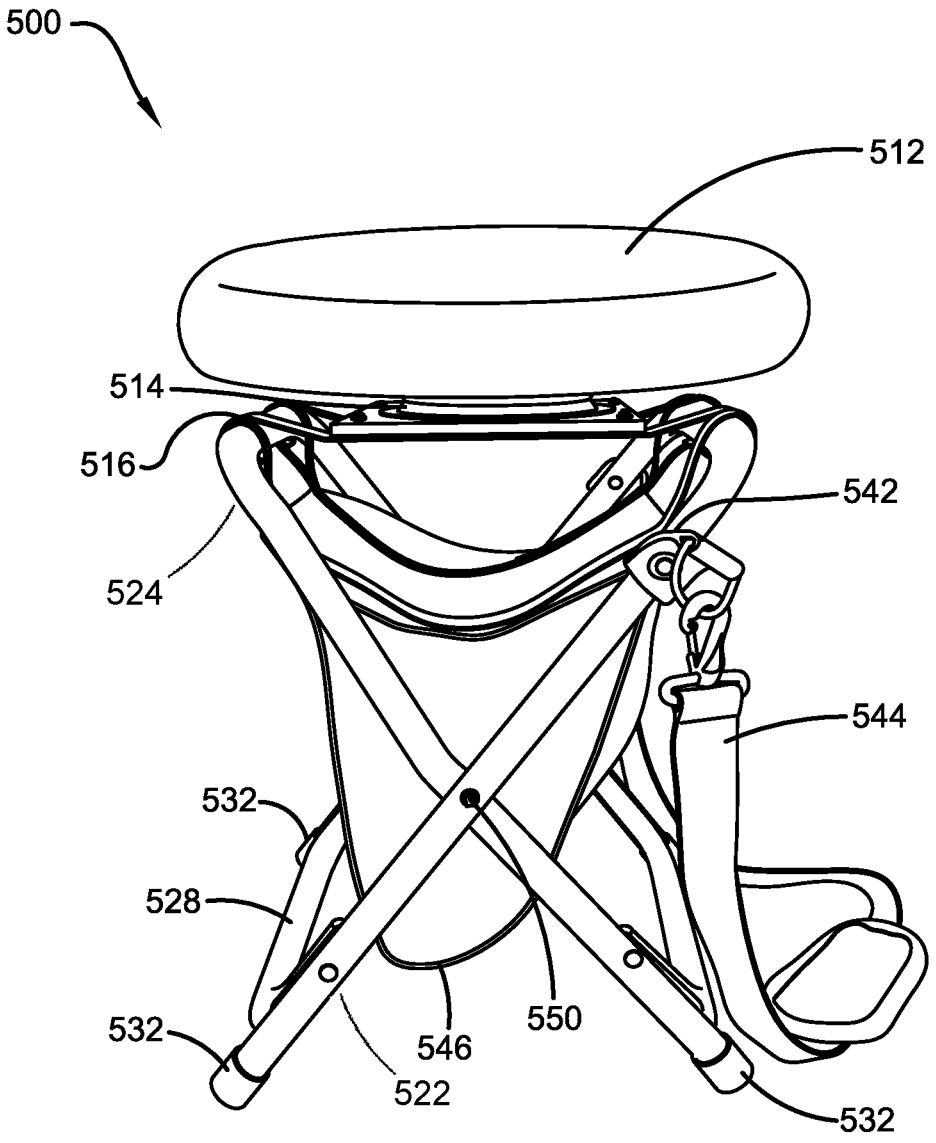
FIG. 5A illustrates another example collapsible stool disclosed herein.
Figure 5B:
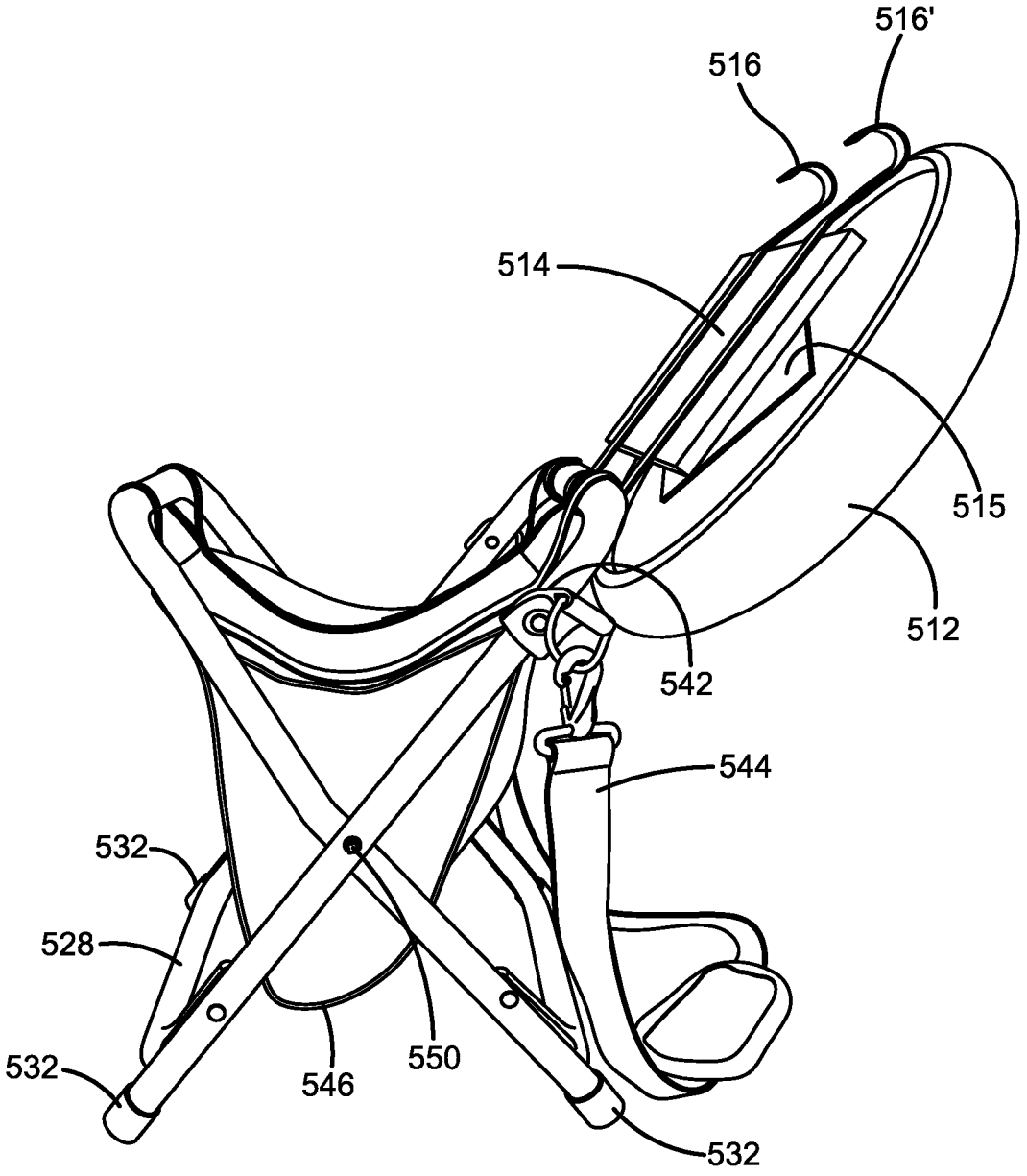
FIG. 5B illustrates another view of the example collapsible stool of FIG. 5A.

FIGS. 5A and 5B illustrate alternative collapsible stool 500 comprising seat section 510 and support section 520. Seat section 510 includes seat 512, coupling assembly 514, and stop hooks 516. Support section 520 includes first leg member 522 and second leg member 524, which are coupled using connection 550 to allow the first leg member 522 and the second leg member 524 to rotate in relation to one another to "open" or "close" support section 520. First leg member 522 can include first leg brace 528, and second leg member 524 can include second leg brace 526. The legs of first leg member 522 and second leg member 524 can include caps 532. Collapsible stool 500 can also include various accessories such as attachment points 542, sling 544, and/or pouch 546. Second leg member 524 can include a deflection above connection 550 in each leg of second leg member 524 to permit collapsible stool 500 to collapse or fold up in a manner substantially similar to that set forth above.

Collapsible stool 500 functions in a manner substantially similar to those described above, except stop mechanisms 116 utilize a detachable hook mechanism. As illustrated, second leg member 524 does not include a deflection as described above, but in alternative embodiments second leg member 524 can include a deflection as shown in other embodiments.

Stop hooks 516 can function similar to stop mechanisms described herein but detach as shown in FIG. 5B. Stop hooks are rotatably attached to first leg member 522 and are attachable and detachable, using the hooks, to second leg member 524. When collapsible stool 500 is open as shown in FIG. 5A, stop hooks 516 coupled with both first leg member 522 and second leg member 524 can include a downward bend from the top of each of first leg member 522 and second leg member 524. The hook of stop hooks 516 can be biased to tighten around second leg member 524 when coupled therewith, and bend or flex during coupling or decoupling.

Pouch 546 can include straps or wraps around first leg member 522 and second leg member 524 to prevent collapsible stool 500 from falling flat when stop hooks 516 are decoupled from second leg member 524. In alternative or complementary embodiments, straps or wraps apart from pouch 546 can be used, or a buffer incorporated in connection 550 can resist further movement of first leg member 522 and second leg member 524 when stop hooks 516 are decoupled.

Figure 2B:
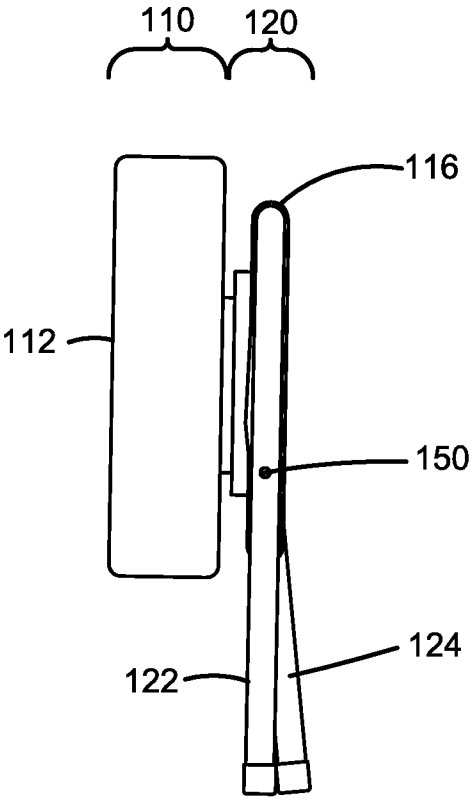
FIG. 2B illustrates a closed arrangement of a collapsible stool disclosed herein.
Figure 2A:
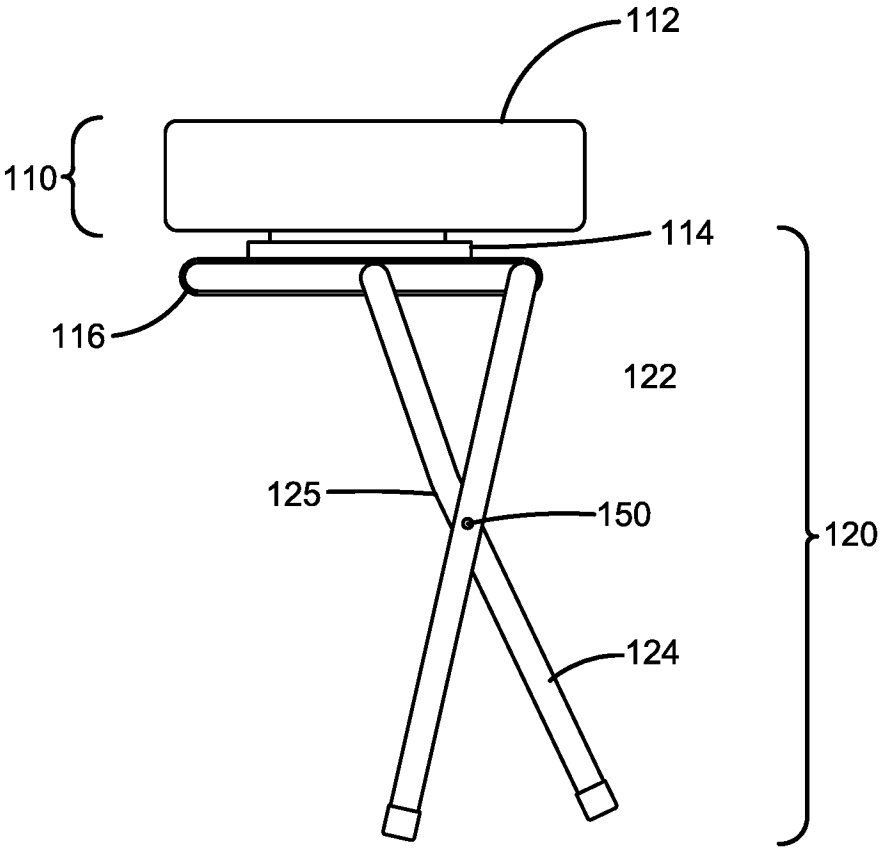
FIG. 2A illustrates a partially-open or partially-closed arrangement of a collapsible stool disclosed herein.

As will be appreciated from FIG. 5A and FIG. 5B in comparison with, e.g., FIG. 1, a variety of different mechanisms can be employed to limit the rotation of legs with respect to one another while still facilitating easy, compact closure of a collapsible stool. Other alternatives within the scope and spirit of this disclosure will be apparent to those of skill in the art on review of this description.

The many features and advantages of the disclosure are apparent from the detailed specification, and, thus, it is intended by the appended claims to cover all such features and advantages of the disclosure, which fall within the true spirit, and scope of the disclosure. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

The invention claimed is:

1. A collapsible stool, comprising:

a first leg member comprising a first pair of legs extending from a first top portion, the first leg member having an inner dimension defining a minimum distance between interior edges of the first pair of legs, each of the first pair of legs having a first length;

a second leg member comprising a second pair of legs extending from a second top portion, the second leg member having an outer dimension defining a maximum distance between exterior edges of the second pair of legs of the second leg member that is less than the inner dimension of the first leg member, each of the second pair of legs having a deflection defining an obtuse angle, and each of the second pair of legs having a second length that is greater than the first length;

a pair of pinned connections rotatably coupling the first leg member and the second leg member, wherein the pinned connection is below each deflection;

a stop mechanism arranged around the first and second top portion, wherein at least the second top portion is configured to translate through the stop mechanism to open and close the collapsible stool, and wherein the stop mechanism is configured to rotate about at least the first top portion, wherein the obtuse angle is open toward the first pair of legs when the second top portion is moved through the stop mechanism away from the first top portion; and a seat operatively coupled with the stop mechanism, wherein the seat is substantially parallel to a plane defined by distal ends of the first pair of legs and the second pair of legs when the first top portion and the second top portion are arranged at opposite ends of stop mechanism based on the first pair of legs and the second pair of legs positioning the opposite ends of the stop mechanism to substantially the same height with the second length greater than the first length based on the deflection of each of the second pair of legs.

2. The collapsible stool of claim 1, wherein the deflection is approximately 10 degrees from a primary axis of each of the second pair of legs.

3. The collapsible stool of claim 1, comprising a coupling assembly disposed between the seat and the stop mechanism.

4. The collapsible stool of claim 3, wherein the coupling assembly includes a plate and a rotation assembly.

5. The collapsible stool of claim 4, wherein the seat is rotatably coupled to the rotation assembly.

6. The collapsible stool of claim 1, comprising at least one leg brace spanning at least one of the first pair of legs or the second pair of legs.

7. The collapsible stool of claim 1, comprising at least one attachment point.

8. A method, comprising:

providing a first leg member comprising a first pair of legs extending from a first top portion, the first leg member having an inner dimension defining a minimum distance between interior edges of the first pair of legs, each of the first pair of legs having a first length;

providing a second leg member comprising a second pair of legs extending from a second top portion, the second leg member having an outer dimension defining a maximum distance between exterior edges of the second pair of legs of the second leg member that is less than the inner dimension of the first leg member, and each of the second pair of legs having a corresponding pair of deflections each defining an obtuse angle, and each of the second pair of legs having a second length that is greater than the first length;

rotatably coupling the first leg member and the second leg member below each of the pair of deflections;

installing a stop mechanism to the first top portion and the second top portion, wherein the obtuse angle is open toward the first pair of legs when the second top portion is moved through the stop mechanism away from the first top portion;

connecting a coupling assembly to the stop mechanism; and rotatably coupling a seat to the coupling assembly, wherein the seat is substantially parallel to a plane defined by distal ends of the first pair of legs and the second pair of legs when the first top portion and the second top portion are arranged at opposite ends of stop mechanism based on the first pair of legs and the second pair of legs positioning the opposite ends of the stop mechanism to substantially the same height with the second length greater than the first length based on the pair of deflections.

9. The method of claim 8, comprising:

attaching caps to the first pair of legs and the second pair of legs.

10. The method of claim 8, comprising:

installing an accessory to at least the first leg member.

11. The method of claim 8, wherein each of the pair of deflections is approximately 10 degrees from a primary axis of each of the second pair of legs.

12. The collapsible stool of claim 1, comprising:

a first leg brace spanning the first pair of legs; and a second leg brace spanning the second pair of legs, wherein the pair of deflections arranges the second leg brace next to or apart from the first leg brace when the first top portion and the second top portion are brought together within the stop mechanism.

13. The method of claim 8, comprising:

installing at least one leg brace spanning at least one of the first pair of legs or the second pair of legs.

14. The method of claim 8, comprising:

installing a first leg brace spanning the first pair of legs; and installing a second leg brace spanning the second pair of legs, wherein the pair of deflections arranges the second leg brace next to or apart from the first leg brace when the first top portion and the second top portion are brought together within the stop mechanism.

* * * * *